US005782534A

United States Patent [19]

Desanta

[11] Patent Number: 5,782,534

[45] Date of Patent: Jul. 21, 1998

[54] CHAIR WITH KNEE SUPPORT

[76] Inventor: Simon Desanta, Schlossalle 18, D-33829 Borgholzhausen, Germany

[21] Appl. No.: 757,966

[22] Filed: Nov. 25, 1996

[30] Foreign Application Priority Data

Nov. 24, 1995 [DE] Germany ..... 195 43 818.3

[51] Int. Cl.[6] ..... A47C 7/50

[52] U.S. Cl. ..... 297/423.13; 297/300.2; 297/452.21

[58] Field of Search ..... 297/1, 94, 118, 297/115, 283.1, 283.3, 283.4, 423.1, 423.11, 452.29, 423.12, 423.13, 452.21, 354.11, 313, 301.4, 301.3, 301.2, 301.1, 300.2, 300.1, 300.6, 300.5, 452.22

[56] References Cited

U.S. PATENT DOCUMENTS

| | | |
|---|---|---|
| 4,736,982 | 4/1988 | Hwang . |
| 4,793,655 | 12/1988 | Kvalheim . |
| 5,054,857 | 10/1991 | Kvalheim . |
| 5,261,727 | 11/1993 | Klaebel . |
| 5,542,746 | 8/1996 | Bujaryn . |

FOREIGN PATENT DOCUMENTS

| | | |
|---|---|---|
| 0017450 | 10/1980 | European Pat. Off. . |
| 0252274 | 1/1988 | European Pat. Off. . |
| 0473291 | 3/1992 | European Pat. Off. . |
| 8307879.7 | 12/1983 | Germany . |
| 3515171 | 10/1985 | Germany . |
| 3490322 | 4/1990 | Germany . |
| 4015841 | 11/1991 | Germany . |
| 4105512 | 8/1992 | Germany . |
| 9303518.7 | 9/1993 | Germany . |
| 88/00016 | 1/1988 | WIPO . |

*Primary Examiner*—Milton Nelson, Jr.
*Attorney, Agent, or Firm*—Spencer & Frank

[57] ABSTRACT

A chair having a seat plate, a seat back supported on a yoke and a knee support. The yoke together with the seat back is foldable forward to a position where the seat back can be used as a knee support.

11 Claims, 5 Drawing Sheets

CHAIR WITH KNEE SUPPORT

CROSS-REFERENCE TO RELATED APPLICATION

This application claims the priority of patent application Ser. No. 195 43 818.3 filed in the Federal Republic of Germany on Nov. 24, 1995, the subject matter of which is incorporated herein by reference.

BACKGROUND OF THE INVENTION

The present invention relates to a chair with a seat plate, a seat back that supports itself on a yoke and a knee support.

Chairs of this type make it possible for the user to occupy a kneeling seating position where the body load is distributed between the posterior and the knees. Examples of such chairs are described in DE-GM 83 07 879, EP 0017450 DE-C2 34 90 322, DE-C2 35 15 171 and numerous other references. Sitting/kneeling chairs of this type are, for example, particularly suited as seating accommodation for data processing work stations or also for other activities where a corresponding seating position is advisable and ergonomically appropriate. However, it must be taken into account here that the body position provided by the chairs of the aforementioned type is suitable to provide relief for some areas of the body, but in the long run can result in the tiring of other areas of the body, so that these chairs can be used in place of other, standard office chairs with adjustment mechanisms. This solution is not very practical however.

It is therefore the object of the invention to create a chair of the initially mentioned type, which can be adjusted such that it can be used as a standard office or work chair as well as sitting/kneeling chair as a defined in the above.

SUMMARY OF THE INVENTION

With the above object in view, the present invention resides in a chair which permits the yoke together with the seat back to be folded forward to a position where the seat back can be used as knee support.

Preferably, the seat plate in the projection for the yoke is divided into two separate seat parts, so that the yoke can be swung forward through the seat plate and the seat back can be used for knee support. However, other modifications are possible. For example, the yoke can be extended laterally to the side in such a way that it can be folded forward and downward either on one side or on both sides of the seat plate. The yoke can also be flat and can support itself on the seat plate while in the forward-folded position.

At the upper end of the yoke, the seat back can pivot around a horizontal axis. Preferably, the seat back is divided in the upward direction by a gap or other type of opening, so that the upholstered inside of the seat back can be turned during the forward folding of the yoke in such a way that the upholstered side faces the knees.

The seat plate and the seat back can be adjusted in the manner that is generally standard nowadays for office chairs, meaning they permit an adjustment between a vertical, if necessary slightly forward pointing seating position and a tilted back resting position for the user. In that case, the seat plate and seat back are connected in such a way that the seat back traverses a considerably larger pivoting angle than the seat plate. A corresponding adjustment mechanism can be realized in various ways. However, one advantageous feature of the solution according to the invention is that the connection between the seat plate and seat back must be detachable if the seat back is to be folded forward.

In accordance with one preferred embodiment of the invention, a frame is connected with the upper end of the post, which frame can be made of a rod stock. The frame is preferably essentially flat and extends from a position at a distance behind the post, at a slanted angle upwards and toward the front, so that it can form an extension in the area in front of the post. The seat plate is positioned such that it can pivot on the front edge of this extension. In this embodiment, a pair of guide members is positioned pivoting at the rear edge of the frame, which pair extends toward the back and up and for which the free ends are guided movably in a sliding guide on the underside of the rear edge of the seat plate. The guide members are elastically prestressed toward the front, so that they have the tendency to lift up the rear end section of the seat plate, but can yield toward the back in case of stress in this end section. The yoke for the seat back is also mounted to this rear section of the frame, such that it can pivot freely, but supports itself toward the rear on a rod that connects the free ends of the guide members. This means that the seat back when it is folded up is synchronized via the rod with the seat plate movement, such as is standard with traditional office chairs, but can be detached from the rod when folding it forward.

BRIEF DESCRIPTION OF THE DRAWINGS

These and other features and advantages of the invention will be further understood from the following detailed description of the preferred embodiments with reference to the accompanying drawings in which.

DETAILED DESCRIPTION OF THE PREFERRED EMBODIMENTS

Figure 1:
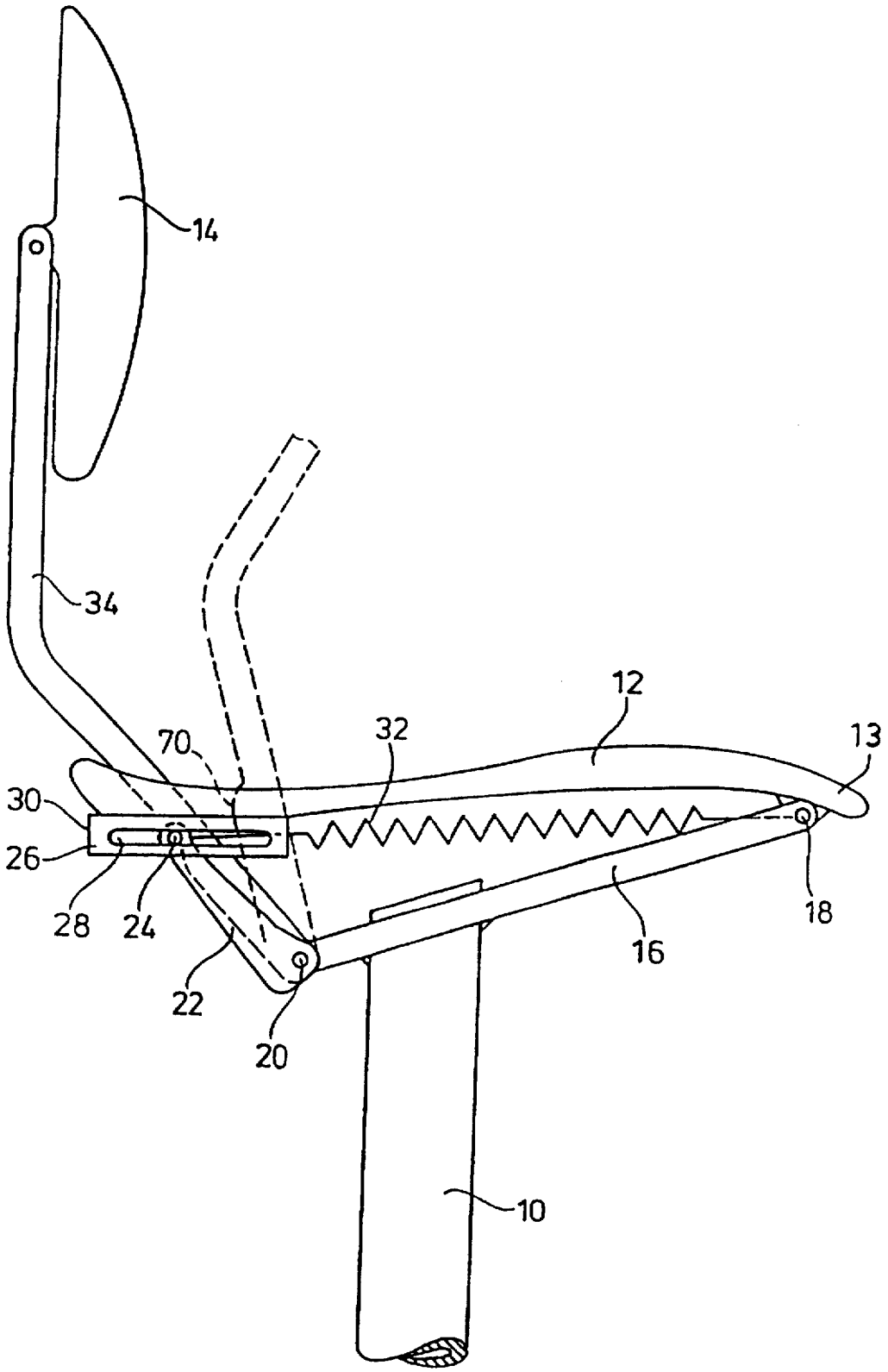
FIG. 1 shows a diagrammatic partial view of a chair according to the invention.

According to the embodiment of FIG. 1, a chair according to the invention comprises a vertical post 10 that originates from a pedestal (not shown), a seat plate 12 and a seat back 14. A frame 16 is attached to the upper end of post 10, which rises from the back toward the front at a slant and which we want to discuss in more detail in connection with FIG. 2.

The seat plate 12 supports itself with its front edge on a first, horizontal, transverse axis 18 on the front edge of frame 16. In the area of post 10, the frame 16 forms an extension arm that rises at a slant toward the front.

On the other side, the frame 16 extends toward the back and over the post. A second axis 20, which is horizontal and transverse, is located there on which two congruent guide members 22 are positioned such that they can pivot. In their normal position, these guide members point up and are more or less slanted toward the back. The two free ends of the guide members 22, of which only one is shown in FIG. 1, are connected by a horizontal rod 24 that is positioned transverse to the seat direction and perpendicular to the drawing plane in FIG. 1. In its two end segments, the rod 24 moves inside essentially horizontal guides 26 that are installed under the rear portion of the seat plate 12 and which are embodied in the illustrated example by oblong holes 28 in a mounting part 30, attached to the underside of the seat plate 12 on both sides of the chair. The rod 24 is connected to the frontal portion of the frame 18, in particular the portion of the first horizontal axis 18, by way of tension springs 32 and it thus prestressed toward the front. The tension springs 32 have a tendency to pull the rod 24 in the oblong holes 28 on both sides of the chair toward the front and thus lift up the rear portion of the seat plate 12 with the aid of the guide members 22.

The seat back 14 is supported on a yoke 34, which is positioned such that it can pivot in the rear portion of the frame 16, in particular the already mentioned second, horizontal axis 20 in the center between the guide members 22. The pivoting movement is limited toward the back, that is to the left in FIG. 1, by the horizontal rod 24, while the yoke 34 basically can pivot freely toward the front, that is to the right of the FIG. 1. A partially folded-forward position of the yoke is shown with dashed line in FIG. 1.

Figure 2:
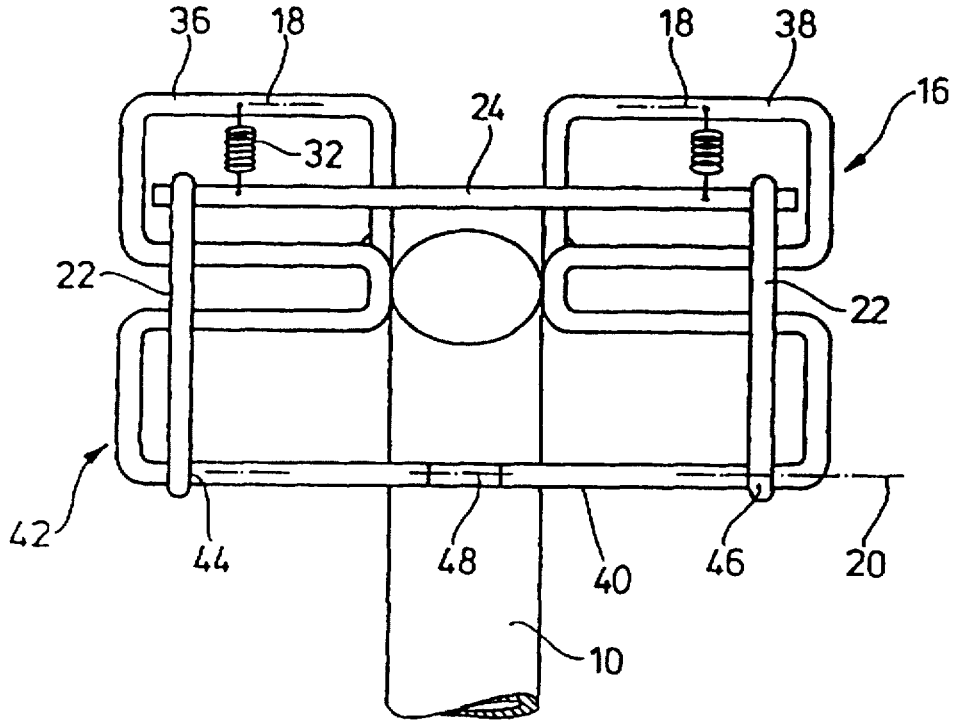
FIG. 2 shows a partial view of the chair back and, in particular, shows the supporting structure for the seat plate and seat back, while the seat plate and seat back are left out for reasons of clarity.

FIG. 2 shows a view of the upper portion of the post 10 and the frame 16 from the back of the chair, meaning from the left in FIG. 1. In this case, the seat plate 12 and a portion of the yoke 34 with the seat back are left out to make it clearer.

In front of post 10, the frame 16 is divided into two partial frames 36 and 38. These are composed of rod stock, which runs initially on both sides of the post 10 toward the front and upwards, then in the opposite direction toward the outside and subsequently curves back toward the post 10 and is attached to the post, e.g. is welded to it. The frontal, transverse segments here form the first horizontal axis 18 for the seat plate that is not shown in FIG. 2.

To the rear of the post, the rod stock again extends from the post in both horizontal directions, then toward the back and downward and finally in a horizontal, transverse segment 40, so that a closed rear frame segment 42 develops, which is essentially rectangular. The rear, horizontal segment 40 forms the second horizontal axis 20, which has already been mentioned in the above.

The bearings 44 and 46 for the pivoting guide members 22 are located on the rear segment 40 of the rear frame portion 42. In the center section of the segment 40 of the rear frame portion 42 is a bearing 48 for the yoke 34 of the seat back, which is not shown in FIG. 2.

One special feature of the chair according to the invention is that the yoke 34 for the seat back 14 can be folded toward the front far enough so that the seat back 14 can function as knee support. For this purpose, the frontal section of frame 16 is divided into the two frame segments 36 and 38, so that there is a free space in the center through which the yoke 34 can move. This is to be explained in more detail in the following.

Figure 3:
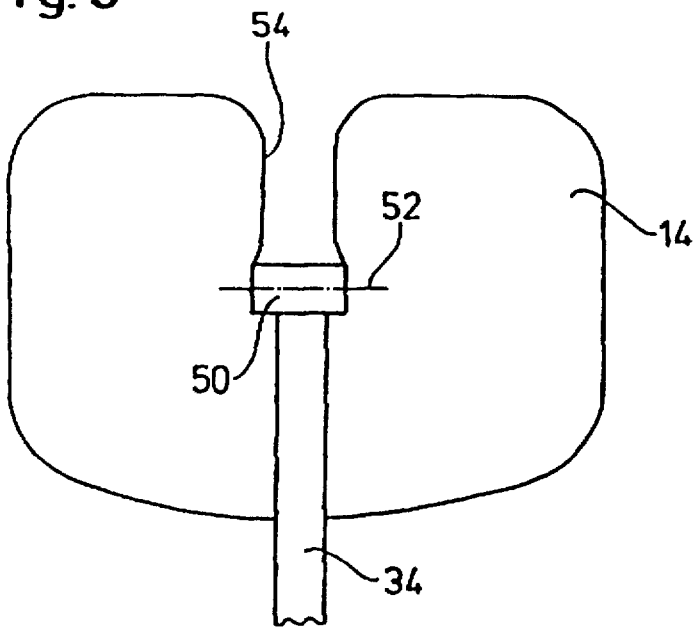
FIG. 3 shows a view from the back of the seat back.

FIG. 3 is a diagrammatic rear view of the seat back 14 and the yoke 34. At the upper end of yoke 34 is a bearing 50, which forms a third axis 52 which extends horizontally and transversely. The seat back 14 can in this way be turned toward the rear of the yoke 34. For a continued pivoting, a suitably shaped slit 54 is provided in the upper half of the seat back 14, above the bearing 15, which permits the yoke 34 to pass through so that the seat back can be pivoted by more than 180° around the axis 52. The slit can be small enough so that it only has enough width to allow yoke 34 to pass through, while a larger recess is possible as well.

Figure 4:
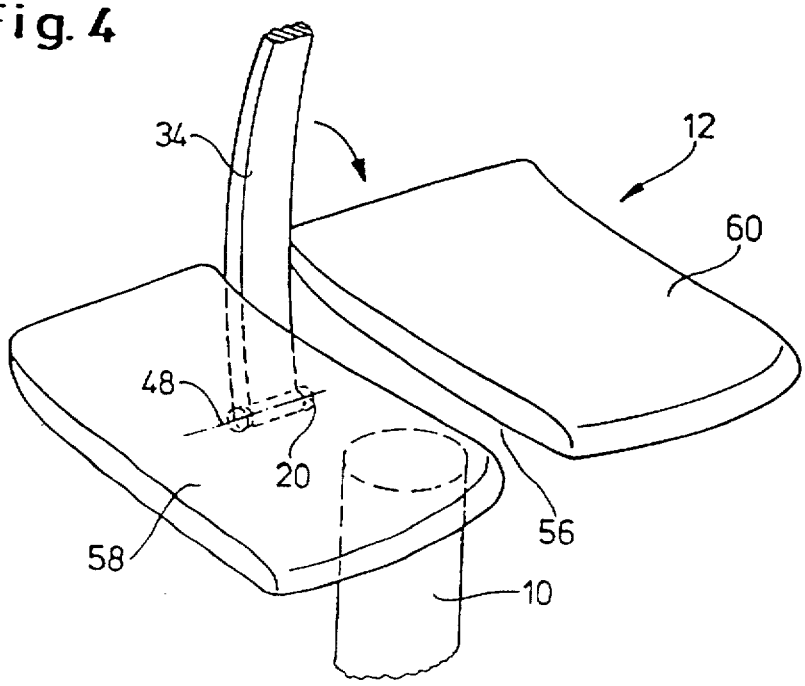
FIG. 4 shows a perspective partial view of an embodiment of the seat plate and the seat back of the chair according to the invention.

FIG. 4 shows an embodiment of the invention for which the seat plate 12 is divided into two completely separate seat plate segments 58 and 60 by a slit 56 running in longitudinal direction through the center.

Figure 5:
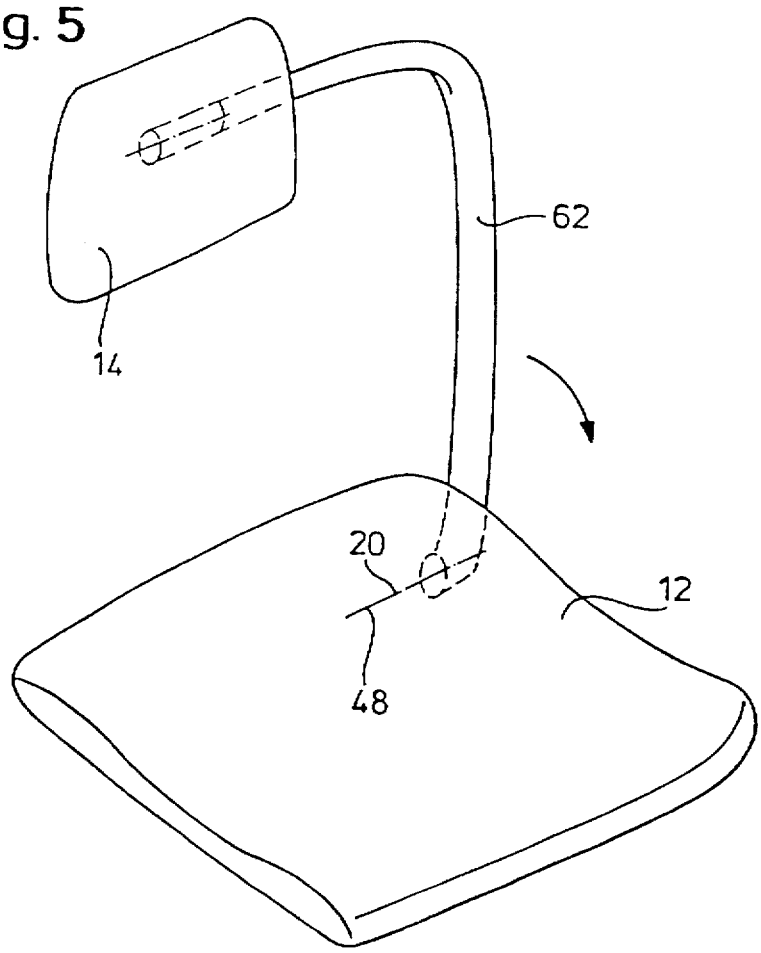
FIG. 5 shows a corresponding perspective partial view of another embodiment.

In a corresponding perspective partial view, FIG. 5 shows an other embodiment according to the present invention having a closed seat plate 12 for which the seat back 14 is supported on a yoke 62, which runs from the seat back 14 to the side edge of the seat plate 12 and from there on down to the second horizontal axis 20. Here, the yoke 62 can be pivoted sideways along the seat plate 12 from the normal position forward. The seat back 14 can be positioned such that it pivots on the upper, horizontal portion of the yoke 62. One drawback of this embodiment is that the user has to climb over the yoke 62 when accessing from one of the two sides, if the sitting/kneeling position is to be used. Furthermore, the yoke has to be relatively stable. A higher stability could be achieved with a yoke, consisting of two parts that can be folded forward along the two sides of the seat plate 12. However, this yoke would have to be climbed over from both sides for the sitting/kneeling position.

Figure 6:
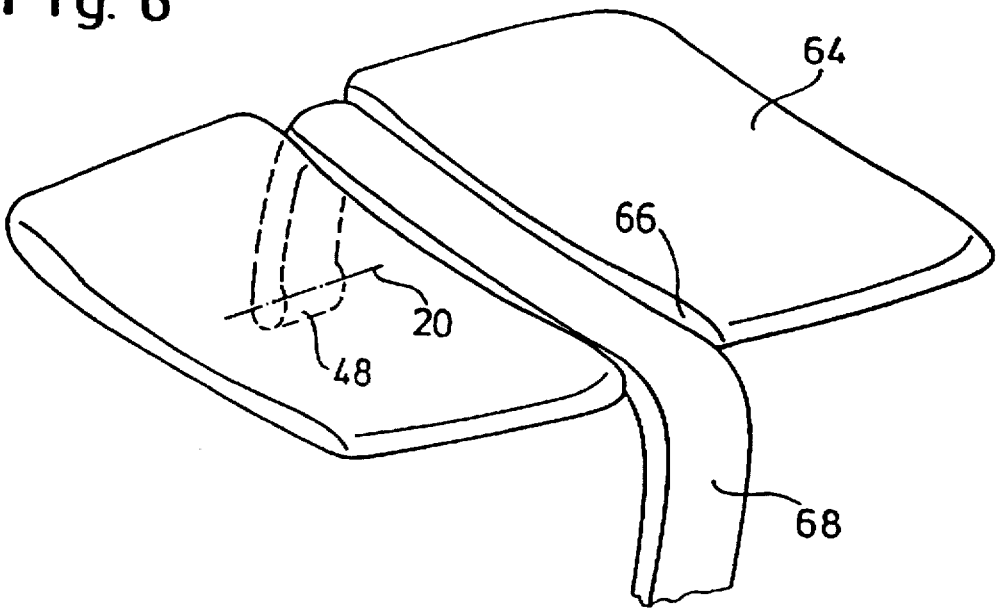
FIG. 6 shows a corresponding perspective illustration of another embodiment of the chair according to the invention.

A seat plate 64 according to FIG. 6 presents another alternative where only a groove 66 runs through the longitudinal center line and not a continuous slit 56 as in the embodiment according to FIG. 4. This groove accepts the forward folded yoke here referred to as 68, such that it is flush.

The operation of the chair according to the invention is described in connection with FIGS. 7A to 7E. The position according to 7A shows the normal operating position where the seat plate 12 is essentially horizontal and the seat back 14 is raised up to be relatively vertical. FIG. 7B on the other hand shows a position where the user of the chair has tilted the chair back for a more relaxed position. Seat plate 12 and seat back 14 have been tilted back in a predetermined relation that is standard for office chairs. During this adjustment movement, the rod 24 slides along the underside of the rear section of the seat plate 12 toward the back, counter to the effect of the tension springs 32, meaning it slides to the left in FIG. 1.

Figure 7A:
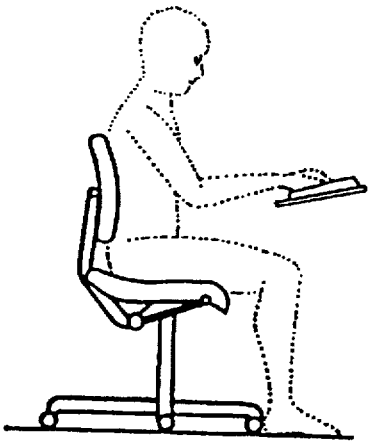
FIG. 7A to 7E show various positions for the chair according to the invention in a diagrammatic view from the side.
Figure 7B:
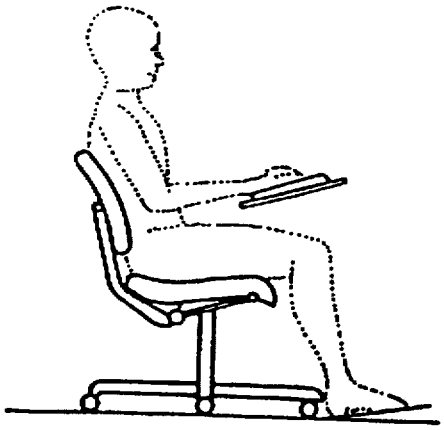
Figure 7C:
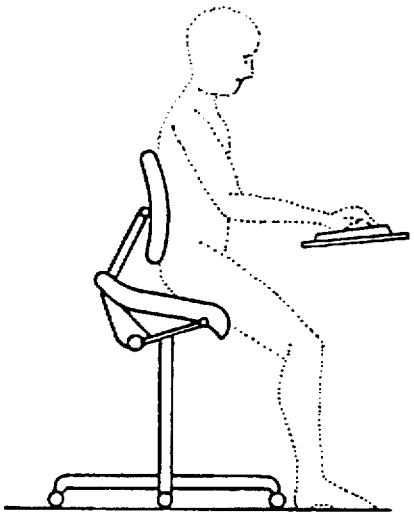

FIG. 7C shows a position where the chair has been lifted up considerably and tilted toward the front, so that the user assumes an essentially standing position. Since the seat back in this case has been tilted far toward the front, the yoke has a slanted gradation 70 on its underside, which is indicated with dashed line in FIG. 1. Since the yoke 34 supports itself on the rod 24 to the left in FIG. 1, as already mentioned, it is clearly lifted up more toward the front when the rod 24 is pushed to the right, as happens during the transition to the position according to FIG. 7C, when the rod impacts with the gradation 70.

Figure 7D:
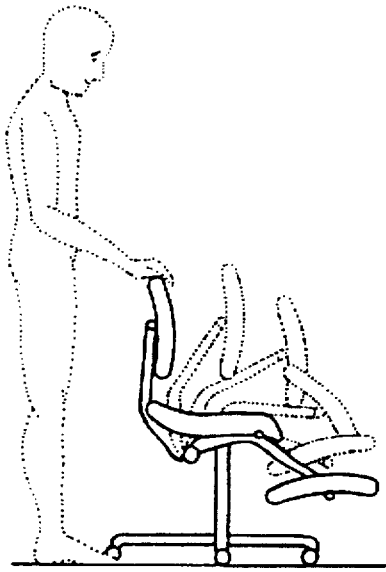
Figure 7E:
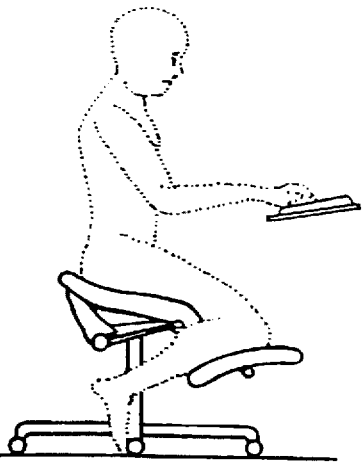

FIGS. 7D and 7E show another adjustment option for the chair during the transition to the kneeling position for the user. In accordance with FIG. 7D, the seat back 14 together with the yoke 34 is in this case tilted completely toward the front. In doing so, the yoke 34 moves through the slit 56 in the seat plate 12 until it reaches the end position pointing forward and downward, as shown in FIGS. 7D and 7E, which is predetermined by the upper end of post 10 or the frame 16 as stop a. At the same time, the seat back 14 is turned with its upper edge toward the rear, with respect to yoke 34, so that the curvature of the seat back 14 points again upwards in the end position and is suitable as knee support. This end position is shown in FIG. 7E.

The chair according to the invention enables the user to use the chair in the two standard working or resting positions according to FIGS. 7A and 7B, furthermore as a standing support according to FIG. 7C and finally as sitting/kneeling chair according to FIG. 7E. The user thus can vary his/her body position over a wide range and can in this way avoid symptoms of fatigue.

It will be understood that the above description of the present invention is susceptible to various modifications, changes and adaptations, and the same are intended to be comprehended within the meaning and range of equivalents of the appended claims.

What is claimed is:

1. A chair, comprising:

a vertically disposed post having an upper end;

a frame attached to the upper end of the post, the frame having a front portion and a rear portion;

a seat plate having a front portion and a rear portion, the front portion of the seat plate being mounted on the front portion of the frame for pivoting movement about a first, horizontal, transverse axis;

a seat back;

a yoke pivotably mounted on the rear portion of the frame, the seat back being mounted on the yoke, the seat back together with the yoke being foldable forward to a position where the seat back can be used as a knee support;

guide members mounted on the frame for pivoting movement about a second horizontal axis, the guide members having free ends;

guides attached to the seat plate;

a horizontal rod connected between the free ends of the guide members, the rod being installed in the guides such that the rod can be moved backward and forward; along a displacement path having a frontal limit position; and springs for elastically prestressing the rod toward the frontal limit position.

2. A chair according to claim 1, wherein the yoke is movable along a pivoting path to the position where the seat back can be used as a knee support, and wherein the seat plate is divided along the pivoting path for the yoke into two separate seat plate segments.

3. A chair according to claim 1, wherein the yoke is displaced to a side of the chair in such a way that the yoke can be folded forward along a side edge of the seat plate.

4. A chair according to claim 1, wherein the yoke is positioned midway between the guide members such that it can pivot between the guide members, wherein the yoke is movable between a back position and the position where the seat back can be used as a knee support, and wherein the yoke is supported on the rod when the yoke is in its back position.

5. A chair according to claim 11, wherein the springs are tension springs which extend between the front portion of the frame and the rod.

6. A chair according to claim 11, wherein the frame comprises rod stock.

7. A chair according to claim 1, wherein the frame is essentially level and rises from a position behind the post, slanting forward toward the front portion of the seat plate.

8. A chair according to claim 1, wherein the seat plate has a longitudinal center line, and wherein said frame is, in an area in front of the post, divided into two frontal frame segments along the longitudinal center line of the seat plate.

9. A chair according to claim 1, wherein the yoke has an upper end, and wherein the seat back is pivotable at the upper end of the yoke around a horizontal, transverse axis, and wherein the seat back has a recess which extends from an area adjacent the axis around which the seat back is pivotable to an edge of the seat back.

10. A chair according to claim 9, wherein the seat back has an edge that is an upper edge when the yoke is in an upright position, and wherein the edge to which the recess extends is said upper edge of the seat back.

11. A chair according to claim 9 wherein the recess is in the shape of a slit.

* * * * *